US008567160B2

(12) United States Patent
Gustafsson

(10) Patent No.: US 8,567,160 B2
(45) **Date of Patent: *Oct. 29, 2013**

(54) METHOD FOR GAS FILLING OF A HANDLE PORTION OF A CONTAINER

(75) Inventor: Per Gustafsson, Bjärred (SE)

(73) Assignee: Ecolean AB, Helsingborg (SE)

( * ) Notice: Subject to any disclaimer, the term of this patent is extended or adjusted under 35 U.S.C. 154(b) by 0 days.

This patent is subject to a terminal disclaimer.

(21) Appl. No.: 13/450,766

(22) Filed: Apr. 19, 2012

(65) Prior Publication Data

US 2012/0198791 A1 Aug. 9, 2012

Related U.S. Application Data

(63) Continuation of application No. 12/680,295, filed as application No. PCT/SE2008/051088 on Sep. 26, 2008, now Pat. No. 8,181,428.

(30) Foreign Application Priority Data

Sep. 28, 2007 (SE) ..... 0702170

(51) Int. Cl.
*B65B 61/14* (2006.01)

(52) U.S. Cl.
USPC ..... 53/403; 53/413; 53/79; 53/134.1

(58) Field of Classification Search
CPC .... B31B 1/86; B31B 2219/909; B31B 19/86; B65D 33/065; B65B 61/14
USPC ..... 53/403, 413, 79, 134.1; 383/3
See application file for complete search history.

(56) References Cited

U.S. PATENT DOCUMENTS

| | | | | |
|---|---|---|---|---|
| 3,730,240 | A * | 5/1973 | Presnick | 383/3 |
| 4,216,639 | A | 8/1980 | Gautier | |
| 4,377,192 | A * | 3/1983 | Gautier | 383/7 |
| 5,788,121 | A * | 8/1998 | Sasaki et al. | 222/105 |
| 7,048,025 | B2 * | 5/2006 | Sperry et al. | 53/79 |
| 7,654,063 | B2 | 2/2010 | Forss | |
| 8,181,428 | B2 * | 5/2012 | Gustafsson | 53/403 |
| 2004/0035865 | A1 * | 2/2004 | Rosen | 220/4.01 |
| 2007/0041669 | A1 * | 2/2007 | Rosen | 383/104 |
| 2007/0068118 | A1 | 3/2007 | Forss | |
| 2007/0089377 | A1 | 4/2007 | Yasuhira | |

FOREIGN PATENT DOCUMENTS

| | | |
|---|---|---|
| EP | 1667917 | 6/2006 |
| GB | 1598843 | 9/1981 |
| SE | 525952 | 5/2005 |
| SE | 526271 | 8/2005 |
| SE | 528619 | 12/2006 |

* cited by examiner

*Primary Examiner* — Stephen F Gerrity
(74) *Attorney, Agent, or Firm* — Volpe and Koenig, P.C.

(57) ABSTRACT

A method for gas filling a handle portion of a container of a collapsible type. The handle portion being defined by two opposite side walls of the container and communicating, via a duct defined by the side walls, with an opening formed in one of the side walls. The method including the steps of supplying, at a gas filling station, a gas to the handle portion via the opening and the duct, blocking the duct by squeezing action to retain the gas supplied to the handle portion, transporting the container to a sealing station while maintaining the squeezing action and, at the sealing station, sealing the duct while maintaining the squeezing action, so as to permanently enclose the gas in the handle portion. The disclosure further concerns a container of a collapsible type.

5 Claims, 3 Drawing Sheets

METHOD FOR GAS FILLING OF A HANDLE PORTION OF A CONTAINER

CROSS REFERENCE TO RELATED APPLICATION(S)

This application is a continuation of U.S. patent application Ser. No. 12/680,295, filed on Mar. 26, 2010, which issued on May 22, 2012 as U.S. Pat. No. 8,181,428, and which claims the benefit of PCT/SE08/051088, filed on Sep. 26, 2008, which is incorporated by reference as if fully set forth.

FIELD OF INVENTION

The present invention relates to a method for gas filling a handle portion of a container of a collapsible type. More specifically, the invention concerns a method for gas filling a handle portion which is defined between the side walls of the container and which communicates with an opening formed in one of the side walls via a duct defined between the side walls.

BACKGROUND

Many different types of container to be filled with products in the form of liquid or powder are currently available. Increasingly, containers of a collapsible type are being used. By a container of a collapsible type is meant a container having a compartment which is defined by flexible walls and whose volume is dependent on the relative position of the walls and, thus, dependent on the filling ratio of the container.

This type of containers may have a number of different handle types.

EP 1 667 917 discloses a container of a collapsible type, which has a handle portion intended to be filled with gas and defined between two opposite side walls. The handle portion communicates via a duct with an opening formed in one of the side walls. Compared with the handle portion, the duct has a significantly smaller cross-sectional area.

EP 1 667 917 further discloses a device for gas filling of the handle portion. A gas supply nozzle is applicable to the opening in the container and by opening a valve gas is allowed to flow through the opening and the duct into the handle portion for expansion thereof. In an immediately following operation, a sealing means arranged radially outside the gas supply nozzle is applied to the duct to provide sealing of the duct so as to enclose the gas supplied to the handle portion. The device may be an integrated part of a filling machine.

Increasingly high demands are placed on the speed at which a filling machine is capable of filling and sealing containers. It has been found that the filling of gas into the handle portion of containers of a collapsible type may be a bottleneck with an adverse effect on the filling capacity of a filling machine. There is, thus, a need for an improved method for gas filling a handle portion of a container of a collapsible type.

SUMMARY

In view of the above, it is an object of the present invention to provide an improved method for gas filling a handle portion of a container of a collapsible type.

A further object is to provide a method of this kind which allows high-capacity production of finished containers.

It is also an object of the present invention to provide a container having a handle portion that can be filled with gas and sealed at high speed.

To achieve these objects, and also other objects that will be evident from the following description, a method having the features described herein is suggested according to the present invention. Embodiments of the inventive method are also described herein.

More specifically, the present invention suggests a method for gas filling a handle portion of a container of a collapsible type, the handle portion being defined by two opposite side walls of the container and communicating, via a duct defined by said side walls, with an opening formed in one of the side walls. The method comprises the steps of supplying, at a gas filling station, a gas to the handle portion via said opening and duct, blocking the duct by means of a squeezing action to retain the gas supplied to the handle portion, transporting the container to a sealing station while maintaining the squeezing action and, at said sealing station, sealing the duct while maintaining the squeezing action, so as to permanently enclose the gas in said handle portion.

An improved method for gas filling a handle portion of a container of a collapsible type is thus obtained, since the method allows high-capacity production of finished containers. The handle portion is filled with gas at a first station, whereupon the duct is blocked by a squeezing action. The container is then transported to a second station while maintaining the squeezing action. At this second station, the duct is sealed while maintaining the squeezing action. By dividing the gas filling and sealing operations into two steps, which are carried out at two separate stations, it is possible to shorten the dwell time at each station, whereby the container production capacity can be increased.

The gas may be supplied by means of a gas supply nozzle, which is applied to the opening.

The duct may be sealed with the aid of a sealing means, which is applied to the container to produce a seal extending across said duct.

The duct may be blocked by a squeezing action produced by a movable pinching means, which grips the container for transport thereof from the gas filling station to the sealing station. The pinching means may be moved along a curved path of motion from said gas filling station to said sealing station.

The method may be a step of a procedure for producing finished containers.

BRIEF DESCRIPTION OF THE DRAWING(S)

FIGS. 3*a*-3*e* are schematic views, partly in perspective, of the different steps for gas filling the handle portion of the inventive container.

DETAILED DESCRIPTION

Figure 1:
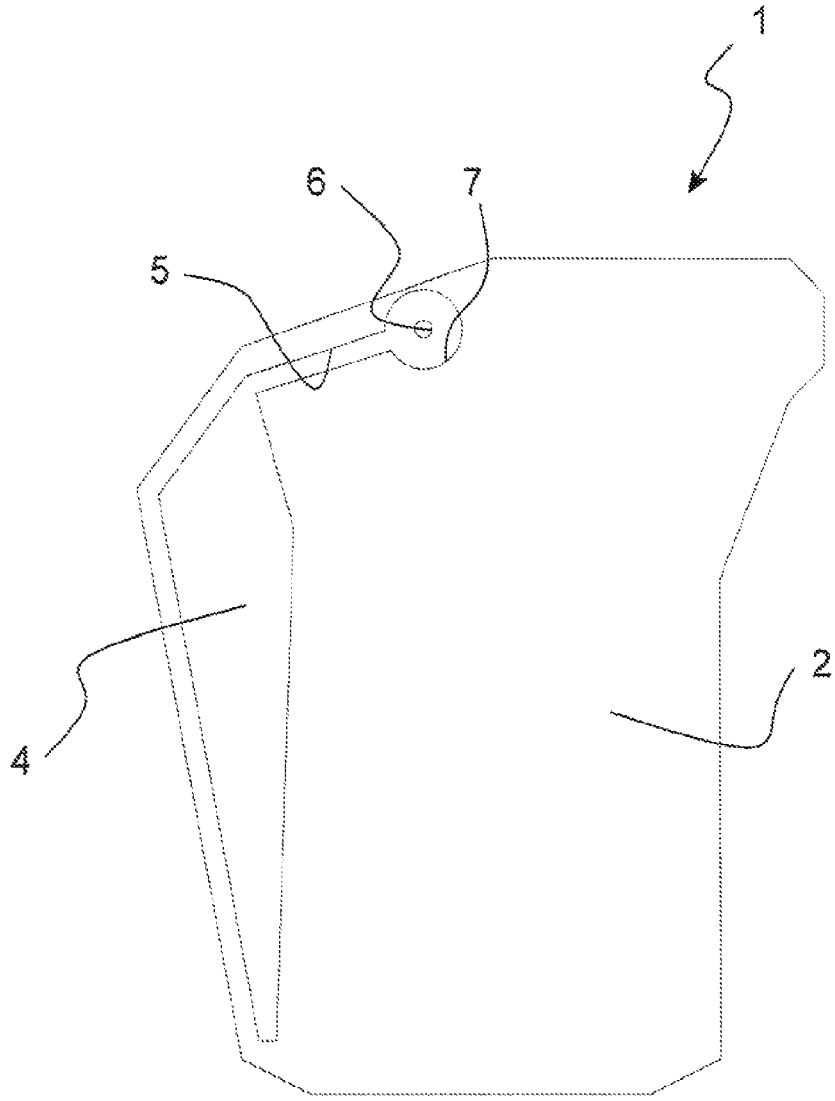
FIG. 1 is a plan view of an inventive container.

With reference to FIG. 1, a container 1 according to the present invention is shown.

The container 1 is of a collapsible type, which means that its walls are flexible and define a compartment whose volume is dependent on the relative position of the walls.

The container 1 comprises two opposite side walls 2 and a bottom wall 3 (shown in FIG. 2), which walls 2, 3 are interconnected along a connecting portion for forming of said compartment.

Furthermore, the two opposite side walls 2 of the container 1 define a handle portion 4, which communicates, via a duct 5, with an opening 6 formed in one of the side walls. Also said duct 5 is defined by said side walls 2. The duct 5 further has a section 7 surrounding said opening 6.

The handle portion 4 is intended to be filled with gas. By filling it with gas a handle that is easy to grasp is obtained, but also a container 1 with increased stability.

When filled with gas the duct 5 has a cross-sectional area that is significantly smaller than the cross-sectional area of the handle portion 4.

The inventive container 1 differs from previously known containers in that the duct 5 has a larger extent for reasons that will be explained below.

Figure 2:
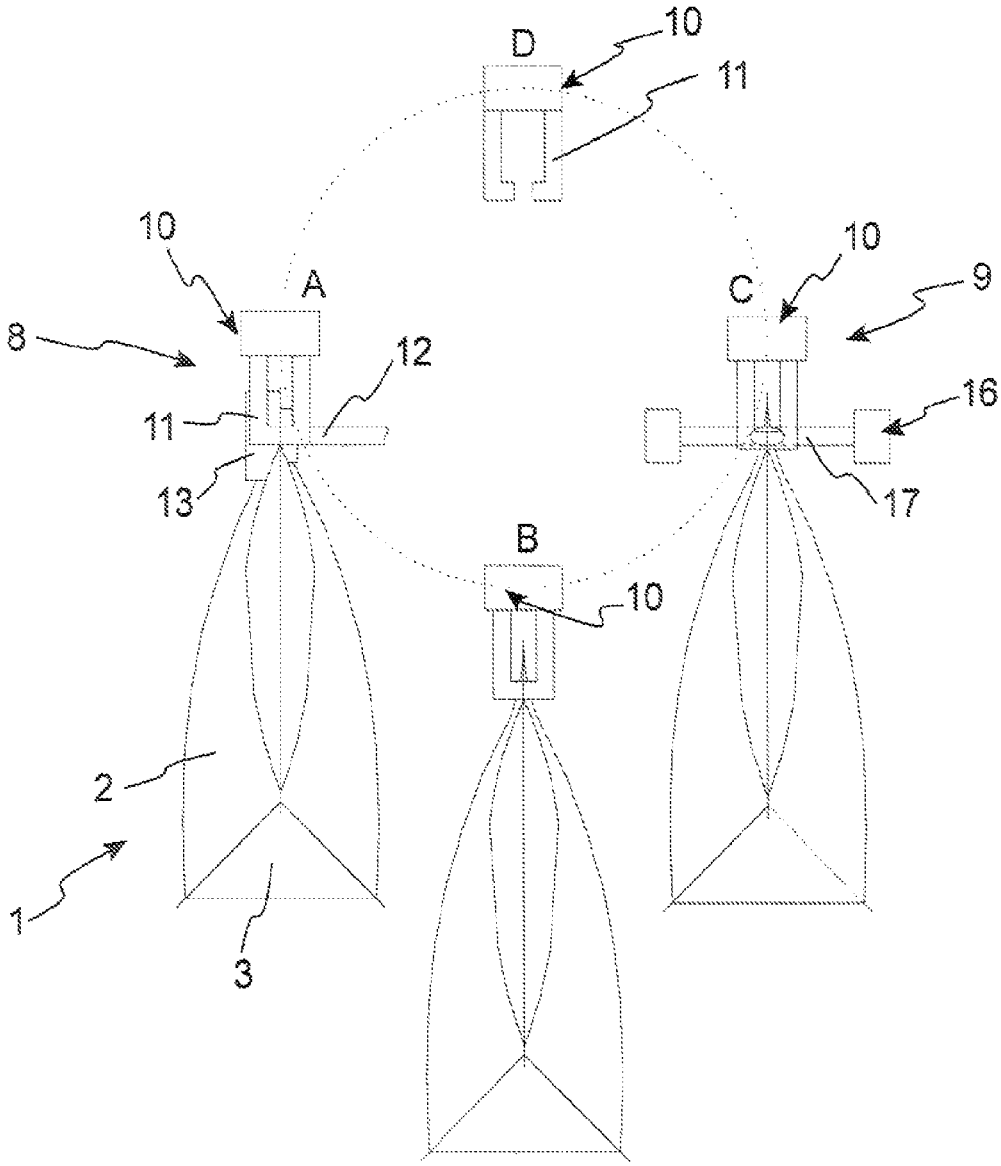
FIG. 2 is a schematic plan view of inventive containers positioned at and between stations for gas filling and sealing a handle portion.

FIG. 2, to which reference is now made, illustrates the method for gas filling and sealing the handle portion 4 of a container of the type shown in FIG. 1. The container 1 is illustrated in three positions A, B and C. The different steps of the method are also illustrated in FIGS. 3*a*-3*e*, to which reference is also made. For the sake of clarity some details are shown in perspective in FIGS. 3*a*-3*e*.

In the first position A, the container 1 is located at a gas filling station 8, in the second position B the container 1 is shown while being transported from the gas filling station 8 to a sealing station 9 and in the third position C the container 1 is positioned at the sealing station 9.

As shown in FIG. 2, the container 1 is moved by means of a movable pinching means 10 comprising two jaws 11 (only one of which is shown in the figure). The movable pinching means 10 is displaceable along an endless, curved path indicated by the dashed line in FIG. 2 and acts to move the container 1 along one half of the path. The movable pinching means 10 thus imparts a curved lateral motion to the container 1 for transport thereof from the gas filling station 8 to the sealing station 9. As a result, the container 1 can be discharged vertically upwards from the gas filling station 8 and can be made do dock vertically downwards with the sealing station 9, the stations 8, 9 being stationary in the vertical direction. In addition, by moving the container 1 laterally, the distance that it must travel from the gas filling station 8 to the sealing station is minimized.

The container 1 has been filled with a content and is shown with the handle portion 4 filled with gas. The contents may be in the form of liquid or powder.

Figure 3C:
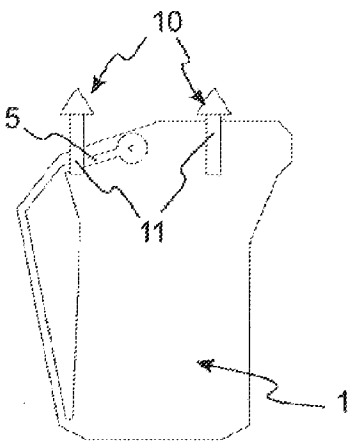
Figure 3B:
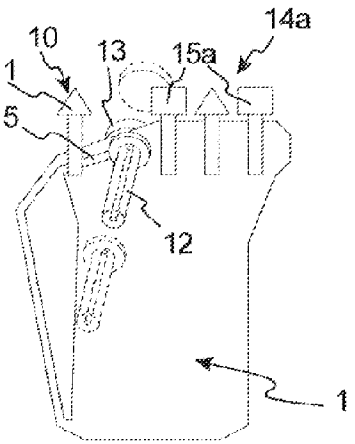
Figure 3A:
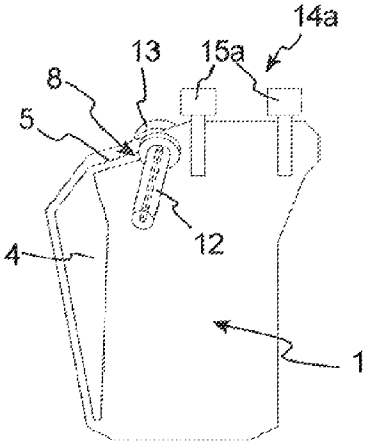

As shown in FIG. 2, the handle portion 4 of the container 1, when located in position A, has been filled with gas by means of a gas supply nozzle 12, which has been applied to the opening 6 in one of the side walls 2 of the container 1, as is shown more clearly in FIG. 3*a*. An abutment 13 may be applied to the opposite side wall 3 of the container 1 for squeezing the container 1 so as to provide an adequate seal between the nozzle 12 and the side wall 3 concerned. By opening a valve (not shown) gas may flow through the opening 6 and the duct 5 into the handle portion 4 for expansion thereof. It is also apparent from FIG. 3*a* that the container 1 is carried by a stationary pinching means 14*a* in the form of two separate jaws 15*a*.

In position A, the movable pinching means 10 has been applied to the gas filling station 8 for gripping the container 1. Gripping occurs when the gas supply nozzle 12 is in the position in which it is applied to the container 1. As mentioned above, the movable pinching means 10 comprises two separate jaws 11, and it is shown, in particular, how one of the jaws 11, when gripping the container 1, blocks the duct 5 by a squeezing action. It is only when the movable pinching means 10 has gripped the container 1 that the gas supply nozzle 12 is retracted, as appears more clearly from FIG. 3*b*, in which the retracted position of the gas supply nozzle 12 is indicated by dashed lines.

As mentioned above, in position B the container 1 is located between the gas filling station 8 and the sealing station 9. The figure shows how the movable pinching means 10 is moved along a curved, endless path, which is indicated by the dashed line, and thus imparts a swinging motion to the container 1. The grip that the movable pinching means 10 exerts on the container 1 is illustrated more clearly in FIG. 3*c*. The figure shows how one jaw 11 maintains its grip so as to block the duct 5 through a squeezing action. As a result, it is ensured that the gas supplied to the handle portion 4 cannot escape during the transport between the two stations 8, 9.

In position C, the container 1 is positioned at the sealing station 9. FIG. 3*d* shows how the movable pinching means 10 has been applied to the sealing station 9 for transferring the container 1 to a stationary pinching means 14*b* which is arranged adjacent to the sealing station 9 and which, too, comprises two separate jaws 15*b*. However, the movable pinching means 10 maintains its grip on the container 1, whereby one jaw 11 of the movable pinching means 10 continues to block the duct 5 through a squeezing action.

While the duct 5 is blocked through a squeezing action, a sealing means 16 is applied to the container for sealing the duct 5. The sealing means 16 may comprise a welding tool 17, which provides a seal 18, in the form of a weld, which extends across the duct 5 and joins together the opposite side walls 2 defining said duct 5 along a portion thereof.

Figure 3E:
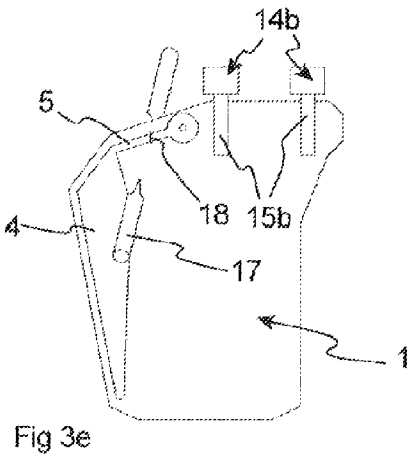
Figure 3D:
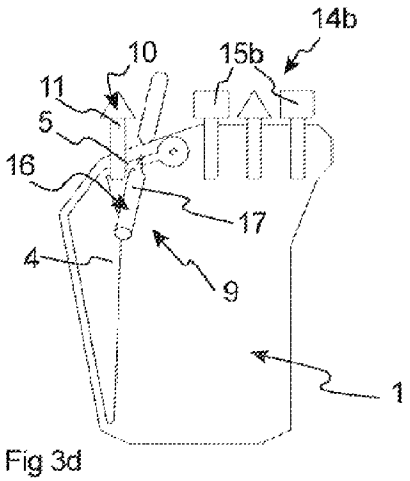

Once the duct 5 has been sealed, the sealing means 16 can be retracted, which is illustrated in FIG. 3*e*. The movable pinching means 10 can then be opened and continue its travel along the curved path, which will take it back to the gas filling station 8, so that the cyclical procedure can be repeated. The opened pinching means 10 is illustrated in a position D in FIG. 2.

According to the present invention, a method for gas filling a handle portion of a container of a collapsible type is thus provided. At a gas filling station, a gas is supplied to the handle portion through an opening and a duct, whereupon the duct is blocked by a squeezing action. The container is transported, while maintaining said squeezing action, to a sealing station, at which the duct is sealed without releasing the squeezing action. Thus, a method is provided which allows gas filling of a handle portion of a container, in which method the gas filling occurs at one station and the sealing for permanently enclosing the gas in the handle portion occurs at another station. By dividing the gas filling and sealing operations into two steps, which are carried out at two separate stations, it is possible to reduce the dwell time at either station, which in turn enables high-capacity production of finished containers.

The inventive method for gas filling the handle portion of the container may be part of a method for producing finished containers. By finished containers is meant containers whose compartment has been filled with a contents and sealed and whose handle portion has been filled with gas and sealed. A method of this kind may comprise the steps of opening a filling duct of an unfilled container, filling the opened container through said filling duct, sealing the filling duct of the filled container, filling the handle portion with gas and sealing the handle portion. These steps may be performed at separate stations, the containers being transported from one station to another by moving them along a curved path as described above.

As stated above, the container comprises a duct connecting the handle portion to the opening. The duct has a length that is appropriate for performing the inventive method. Thus, the duct has an extent such that the duct may be blocked by a squeezing action to retain the gas when the handle portion has been filled. This means that the duct has a length such that one pinch of the movable pinching means will squeeze the duct when the gas supply nozzle has been applied to the opening, as shown in FIG. 3*b*. In addition, the duct has such an extent as to enable squeezing of the duct for blocking thereof while at the same time sealing the duct for permanently enclosing the gas supplied to the handle portion. Accordingly, the length of the duct is such that the welding tool can be applied to the duct for producing a weld extending across the duct at the same time as one jaw of the movable pinching means squeezes the duct.

It will be appreciated that the present invention is not limited to the embodiment shown, but that various modifications and variations are conceivable. Therefore, the invention is limited solely by the appended claims.

What is claimed is:

1. A method for gas filling a handle portion of a container of a collapsible type, the handle portion being defined by two opposite side walls of the container and communicating, via a duct defined by said side walls, with an opening formed in one of the side walls, said duct having, in an inflated state, a cross-sectional area being significantly smaller than a cross-sectional area of the handle portion, the method comprising supplying, at a gas filling station, a gas to the handle portion via said opening and said duct, moving said container laterally to a sealing station by a pinching member arranged to grip said container such that a blocking of the duct is obtained by a squeezing action to retain the gas supplied to the handle portion, and sealing the duct, at said sealing station, by a weld seal extending transverse said duct while maintaining the squeezing action, so as to permanently enclose the gas in said handle portion.

2. A method according to claim 1, in which the gas is supplied by a gas supply nozzle, which is applied to the opening.

3. A method according to claim 1, in which the duct is blocked by a squeezing action produced by a movable pinching device, which grips the container for transport thereof from the gas filling station to the sealing station.

4. A method according to claim 3, in which said pinching device is moved along a curved path from said gas filling station to said sealing station.

5. A method according to any claim 1, in which the method is a step of a process for producing finished containers.

* * * * *